United States Patent [19]

Karst et al.

[11] Patent Number: 4,541,409

[45] Date of Patent: Sep. 17, 1985

[54] BACKSHELF COMPENSATING EXHAUST HOOD APPARATUS

[75] Inventors: Daniel Karst, Beaver Dam; Gary Strege, Watertown; E. Richard Larsen, Horicon, all of Wis.

[73] Assignee: Maysteel Corp., Mayville, Wis.

[21] Appl. No.: 617,725

[22] Filed: Jun. 6, 1984

[51] Int. Cl.[4] ..... F24C 15/20

[52] U.S. Cl. ..... 126/299 D; 55/DIG. 36

[58] Field of Search ..... 126/299 R, 299 D, 299 E; 55/DIG. 36; 98/36, 115 R, 115 LH

[56] References Cited

U.S. PATENT DOCUMENTS

| | | | |
|---|---|---|---|
| 4,047,519 | 9/1977 | Nett | 126/299 D |
| 4,141,342 | 2/1979 | Kuechler | 126/299 D |
| 4,153,044 | 5/1979 | Nett | 126/299 D |
| 4,286,572 | 9/1981 | Searcy et al. | 126/299 D |

*Primary Examiner*—James C. Yeung

*Attorney, Agent, or Firm*—Andrus, Sceales, Starke & Sawall

[57] ABSTRACT

A backshelf compensating exhaust hood includes an upper wall passageway for forming and redirecting an induction air stream into and through an exhaust chamber to an exhaust passageway, the upper wall passageway extends through the upper wall to a smooth curved reverse passageway redirects the air into a short slot which discharges a stream into the upper end of the exhaust chamber. A forward tilted filter is located in the exhaust chamber to form the back wall of the exhaust chamber and with the lower end spaced inwardly of the upper end and with the upper portion aligned with the induction air stream. The filter is oriented to define an essentially right angle with the interior upper wall of the exhaust chamber. The top wall of the exhaust chamber extends inwardly and upwardly slightly to the filter. The induction air supply passageway is a relatively large passageway which has a depth which is a multiple of the depth of the slot. The inlet expands slightly to the deflector and reverse passageway to the discharge slot. The discharge slot includes a short extension of the deflector wall as an essentially flat wall which extends parallel to the top wall of the exhaust chamber. For a gas fired unit, an exhaust duct is located to the backside of the hood for upwardly spaced alignment with flue duct of the equipment. The spaced exhaust duct of the hood projects upwardly into the exhaust passageway for exhausting of the combustion gases and the secondary air introduced between the flue duct and the exhaust duct.

9 Claims, 2 Drawing Figures

BACKSHELF COMPENSATING EXHAUST HOOD APPARATUS

BACKGROUND OF THE PRESENT INVENTION

This invention relates to a backshelf compensating exhaust hood apparatus and particularly to such a hood apparatus adapted to be mounted adjacent commercial cooking equipment or to other industrial, institutional or commercial devices generating fumes, particles and the like to be exhausted therefrom.

Cooking equipment in restaurants and other institutional kitchens generate fumes which are desirably exhausted from above the appliance to the exterior of the room and/or building. This is particularly true of gas fired grills, griddles, deep-fat fryers and the like. In practically all commercial kitchens, as well as various industrial and institutional work areas, an exhaust hood is mounted in overlying relationship to the work area and is operable to draw the contaminated environment from the work area and discharge the contaminated environment to the exterior of the enclosure. Various types of wall and appliance mounted exhaust hoods have been developed. A particularly satisfactory compensating exhaust unit which has been commercially developed is disclosed in U.S. Pat. No. 4,153,044 which issued Aug. 8, 1979 to Louis A. Nett and which is assigned to a common assignee with the present invention. The exhaust hood disclosed in such patent is typically identified as a backshelf type of exhaust apparatus. The unit is adapted to be mounted on a wall or directly to the cooking equipment, with a back wall which projects upwardly above the cooking area. An exhaust chamber is located to the back side of the appliance and includes a filter through which the exhaust from the equipment is passed to remove grease and other types of objectionable foreign matter prior to discharge to the room exterior. The filter is inclined forwardly over the cooking equipment. The backshelf exhaust hood of the patent provides a low profile induction unit, with induction air supplied through a special passageway in the upper wall portion of the exhaust hood. The backshelf exhaust hood is generally defined by a top wall and partially enclosing vertical side wall which generally includes the back wall and opposite side walls, all of which may be supported off the floor by a plurality of support legs, or attached to a wall for support. Injected air under pressure is directed through a supply duct and the top wall to form an induction air stream which passes across the exhaust hood into the filter. An exhaust duct is mounted behind the supply duct and leads from the exhaust chamber to the exhaust fan. Air, preferably, from outside the building, is drawn in by an intake fan and forced under pressure through the supply duct and the top wall of the hood enclosure, as more fully developed in the above patent. Interior walls within the enclosure define an air supply channel or passageway which directs the incoming induction air to the front of the top wall. A deflector panel mounted at the front of the top wall portion redirects the flowing air backwardly and downwardly at an angle toward the exhaust passageway in the back of the apparatus, such that the downwardly flowing air strikes the filter at substantially a right angle. The high velocity stream of induction air provides an area of lower than ambient pressure and draws vapor arising from the cooking surface upwardly into the filter and thereby assists the function of the exhaust fan. As more fully disclosed in said patent, the air supply passageway in the upper wall portion is specially constructed to produce a smooth flow of air from the hood into the exhaust chamber with the air stream directed rearwardly and downwardly at an angle to engage the upper end of the filter. The filter is specially angularly oriented rearwardly with the lower end located outwardly of the upper end and is oriented such that the downwardly directed stream engages the filter substantially at right angles in the upper portion.

Provision is also made for separate exhaust of combustion gases from gas fired equipment. An exhaust duct in the hood is located to be spaced from the exhaust flue of the equipment, and includes an adjustable baffle for adapting to different equipment. Separate exhaust of combustion gases is desirable, since the expansion of the combustion gases and intermixed air would substantially increase the required exhaust volume flow rate if these gases were exhausted through the primary exhaust chamber. The hot combustion gases also tend to heat up a grease filter when passing therethrough which degrades the ability of the filter to congeal grease onto the filter from the exhaust fumes.

Although the induction hood such as shown in the above patent has found wide commercial acceptance, conditions have arisen wherein optimum exhausting from a cooking range has not been obtained with present day backshelf hood devices.

SUMMARY OF THE INVENTION

The present invention is particularly directed to a back shelf compensating exhaust hood apparatus of the type having an upper wall passageway for redirecting of induction air stream into and through an exhaust chamber to an exhaust passageway, and particularly to an improved reorientation of the filter and air flow to optimize the removal of the contaminated environment above an appliance. Generally in accordance with the teaching of the present invention, a backshelf hood apparatus includes an upper wall passageway extended to the front or forward wall of the upper wall unit and to a reverse curved passageway redirecting the air into a slot which discharges a stream into the uppermost portion of the exhaust chamber and generally as a horizontal or upwardly directed stream. A forward tilted filter means is located within and defines the back wall of the exhaust chamber with the lower end spaced inwardly of the upper end and with an upper portion aligned with the induction air stream. The filter means is positioned within the hood to form a common wall between the exhaust chamber and an exhaust passageway.

In a preferred construction, the supply passageway is specially constructed with a relatively large passageway along the upper portion of the top wall unit which is slightly inclined downwardly and merges with a smooth and essentially curved return or reverse passageway at the front of the top wall unit. The discharge slot is defined by the immediately adjacent upper wall of the exhaust chamber and a short extension of the front reverse passageway wall. The induction air stream is introduced to flow along the upper wall of the exhaust chamber but spreads downwardly into the chamber to define a generally fan-like pattern. The stream engages essentially the upper third portion of the filter means.

More particularly, in an optimum construction of the present invention, the filter is oriented to define an essentially right angle with the interior upper wall of the exhaust chamber. The top wall of the exhaust chamber extends inwardly and upwardly slightly to the filter bracket. The filter or grease trap may be a replaceable rectangular unit secured within a holder or bracket extending substantially perpendicular from the top wall of the exhaust chamber. The filter is generally an expanded metal mesh or a multiple baffle construction, but may be of any desired construction. A grease cup is secured to the lower end of the filter unit. The induction air supply passageway is a relatively large passageway which has a depth which is a multiple of the depth of the nozzle. The inlet expands slightly to the deflector and reverse passageway. The reverse passageway is a generally shallow U-shaped passageway. The discharge nozzle includes a short extension of the deflector wall as an essentially flat wall which extends parallel to the top wall of the exhaust chamber. The side walls and the front outer wall of the top wall unit have a rearwardly inclined front edge portion defining an esthetically pleasing backshelf hood, and providing maximum accessibility to the equipment.

In a gas fired equipment a gas exhaust flue means is secured to the backside of the equipment. The hood is located adjacent the gas fired equipment with a coupling duct aligned with and spaced slightly above the gas exhaust flue means. The coupling duct projects upwardly into the hood exhaust passageway for direct exhausting of the gas fumes and the like into the exhaust passageway. The coupling duct includes an adjustable baffle to adjust the same to the particular piece of equipment. A protective grease wall member is mounted overlying the exit end of the gas duct to prevent movement of grease into the gas exhaust duct.

The inventor has found that the backshelf unit with the specially shaped passageway to direct the air generally horizontally with a slight upward bias or direction and the reverse or forwardly tilted filter provides a most effective apparatus for exhausting the fumes from above a work area, as well as maximum accessibility to the work area, such as in a commercial or institutional kitchen, industrial work area and the like.

DESCRIPTION OF THE DRAWING FIGURES

The accompanying drawing illustrates the best mode presently contemplated by the inventor for carrying out the invention.

In the drawing:

FIG. 1 is a pictorial view of a back shelf hood exhaust unit constructed in accordance with the teaching of the present invention; and FIG. 2 is a vertical section through the back shelf hood unit shown in FIG. 1.

DESCRIPTION OF THE ILLUSTRATED EMBODIMENT

Figure 1:
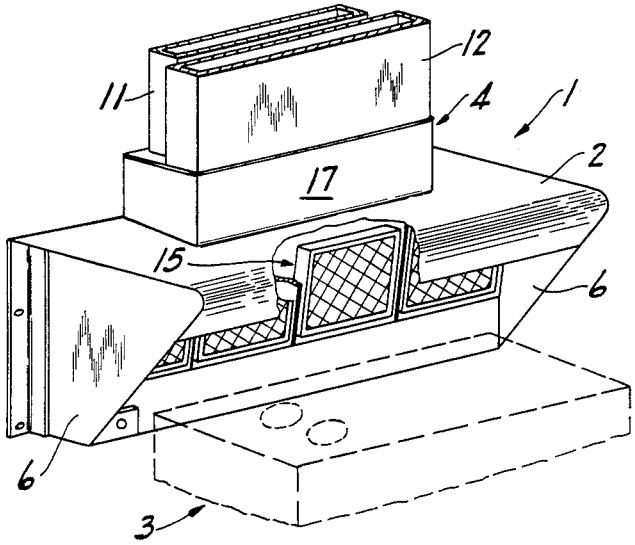

With reference to the drawing and particularly FIG. 1, a backshelf compensating exhaust hood 1 having a flat countertop 2 is shown generally overlying a gas fired cooking unit 3, such as a grill, griddle, or deep-fat fryer. The hood 1 is formed of a top wall unit 4 including the countertop 2, a back wall 5, and a pair of side walls 6.

Each of the side walls 6 and the back wall is generally shown as a sheet metal member welded or otherwise secured to each other and to the top wall unit 4. The front of the hood tapers downwardly and inwardly to expose the top of the unit 3 from the front and side portions of the assembly. Portions of the top wall unit 5 have been shown broken away in FIG. 1 in order to better illustrate the internal structure of the hood enclosure as hereinafter described. The hood 1 is generally of the type shown in U.S. Pat. No. 4,153,044 and is shown as a wall-mounted unit adapted to be affixed to a wall behind cooking unit 3 or other appliance. The device may be made self-supporting for floor mounting by a plurality of support legs, not shown.

The enclosure formed by the hood 1 partially surrounds the cooking unit 3, other similar kitchen device or any industrial, institutional or other fume producing equipment. The hood 1 forms an exhaust chamber 7 overlying the unit 3 and aids in containing the fumes 8 arising from the surface of the equipment, and more importantly allows the fumes and associated foreign matter to be efficiently exhausted with less withdrawal of room air than is required with other types of ventilating equipment such as ceiling mounted hoods. Exhaust fumes and entrained foreign materials are drawn from the exhaust chamber 7 into an exhaust passageway 9. An exhaust duct 11 is secured to the top wall unit and projects upwardly from the passageway 9. The hood 1 operates on an induction exhaust principle and outside untempered air is supplied via an air intake supply duct 12 to an opening 13 in the top wall unit 4 of the hood 1, and moves forwardly through unit 4 and then backwardly into the exhaust chamber 7. The ducts 11 and 12 may be enclosed within an outer shell for appearance.

The air is preferably introduced under significant pressure to form a curtain 14 which passes through and across the chamber 7 into the exhaust passageway 9. The high speed air curtain 14 captures the fumes 8 arising from the surface of equipment 3 and projects such fumes into the exhaust passageway 9, and preferably also by appropriate flow of the curtain provides additional reduced pressure by virtue of the venturi-type effect accompanying the high speed air flow to draw the fumes upwardly into the exhaust chamber 7 which then pass into and through the exhaust system.

For most kitchen and other applications where grease or other material is to be extracted from the air being exhausted, a suitable filter unit 15 is interposed in the hood and forms a common wall between the exhaust chamber 7 and the exhaust passageway 9. The filter 15 and the orientation of the exhaust opening are in the present invention canted forwardly as shown, preferably at an angle of approximately 15°. The air curtain 14 is oriented to move backwardly and upwardly and thus within the upper end of the exhaust chamber 7 so as to engage the grease filter unit 15 at the upper end portion and approximately at a right angle to minimize vortexing at the filter and substantial loss of exhaust efficiency as a result.

More particularly, the hood and particularly wall unit 4 includes an insulated upper or top wall 16 extending horizontally across the width of the hood enclosure from a supply and exhaust duct housing 17. The induction air supply duct 12 is located to the front of housing 17 and terminates in a passageway 18 in the top wall unit 4. The channel or passageway 18 and inlet opening thereto preferably extends laterally for the entire length of the hood, or at least for the length of the area of the range which is to be ventilated. The passageway 18 is formed to smoothly deflect the downwardly moving incoming air into a horizontal direction toward the front of the top wall unit 4.

The passageway 18 extends forwardly and expands to a curved reverse deflecting passage 19 at the front of the top wall unit 4 to smoothly deflect the forwardly moving incoming air and redirect it backwardly into and across the exhaust chamber 7 and toward the exhaust passageway as the air curtain 14. The deflecting passageway 19 is preferably formed without sharp edges or corners in order to maintain an essentially smooth and preferably laminar flow in curtain 14. The deflecting passageway 19 terminates in a short nozzle slot 20 at the front wall which directs the air curtain 14 to move along the upper wall 21 of the chamber 7.

The induction air stream 14 preferably moves at a high velocity and in a narrow stream across the upper portion of the chamber 7, with the confining and directing slot 20 creating a substantially laminar flowing curtain 14.

The present invention is particularly directed to orientation of the induction stream, the construction of the induction air supply passageway within the upper top wall unit 5 and the orientation of the filter assembly 15 with respect to the induction air stream 14, and no further description of the other parts of the apparatus is given other than as desirable to fully describe the present invention.

More particularly, the top wall unit 4 is a box-like unit having a flat top wall with one or more openings for connection to the air supply duct 12 and the exhaust duct 11. In accordance with the conventional practice, the air supply is a suitable fan unit coupled to draw air from the exterior of the building and to provide a pressurized supply within the air channel or passageway. As the air particularly during the cold months may be quite cold and would tend to create a cold area around the unit, the top hood unit 4 is formed as an insulated shell member.

The several walls of the top wall unit 4 are double-panelled sheet metal walls and insulated with standard insulating materials 23 that are non-flammable and non-toxic so that the outside surfaces of the board remain at substantially the temperature of the surrounding room air. The untempered air through the air supply channel 18 is brought in directly from the outside and may be untempered or only partially tempered, and thus may be substantially warmer or colder than the room air within the kitchen. The insulated walls minimize condensation of moisture on the outside surfaces of the hood structures.

The bottom wall 24 of the supply passageway 18 preferably inclined in accordance with wall 21 and creates an enlargement of the plenum or passageway 18 from the supply duct 15 to the front wall portion and particularly the reverse passageway 19.

At the forward or front wall portion, a deflector wall 25, which forms the outer wall of passageway 19, is joined to the horizontal passageway 18 by a large curved corner 26 which is preferably a continuous, smooth wall to a generally vertical front wall 27 which extends downwardly toward the working area of the equipment. The wall 27 is generally a flat wall end is substantially parallel to the inclined filter assembly and thus perpendicular to the top wall 21 of the exhaust chamber 7. A smooth, curved connecting portion or corner 28 connects the vertical wall 27 to a short, flat slot wall 29 which projects into the exhaust chamber 7 toward the filter assembly 15. A slot wall 29 is generally shown as a flat planar member which projects rearwardly and upwardly from the curved corner 28. Where curved walls are shown and described, the structure preferably has a continuous smooth curvature, but may be formed by a substantial plurality of breaks in accordance with commercial practice.

The upper wall 21 of the exhaust chamber is a flat wall located in upwardly spaced relation to the slot wall 29. The top wall extends forwardly and downwardly at a slight angle and generally perpendicular to the filter unit 15. The slot wall 29 in the illustrated embodiment is located essentially parallel to the upper wall 21 of the exhaust chamber and forms the slot 20 as a relatively short slot of a constant depth which directs the stream 14 upwardly and rearwardly along or adjacent the upper wall 21 of the exhaust chamber.

The filter assembly 15 includes a supporting frame 20 secured between the opposed side walls 6, the top wall unit 4 and a bottom wall unit 31. The frame 30 defines a rectangular channel within which a plurality of similar filter units 32 are releasably mounted in accordance with conventional practice. The filter units 32 may be of any suitable or desired construction, such as a commercially available expanded aluminum mesh or a centrifugal action baffle. In accordance with the teaching of the present invention, the frame and filter units are specially located in angular orientation within the hood apparatus with the filter units 32 tilted forwardly. In the illustrated embodiment, the upper end is essentially located immediately adjacent to the interior wall 21 of the exhaust chamber 7 which is also the bottom wall of the top wall unit 4. The induction air stream 14 is fed from the slot 20 into the hood along the direction of such wall. The induction air stream spreads downwardly slightly as it moves through the exhaust chamber 7, developing a generally fan-shaped configuration. The expansion is such that the stream approximately engages the upper one-third of the filter unit.

Figure 2:
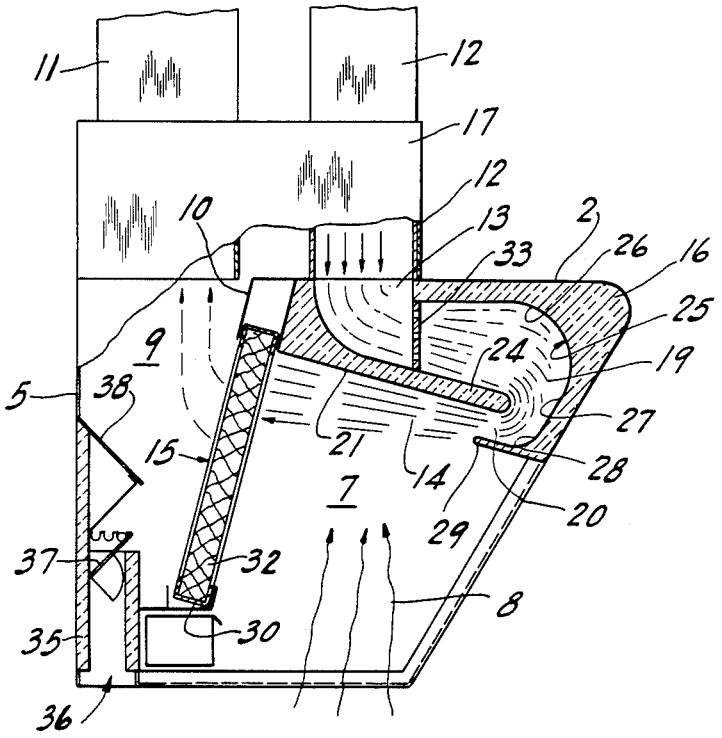

As shown in FIG. 2, a perforated baffle plate 33 extends longitudinally of passageway 18 adjacent the air supply duct 12. The plate 33 extends to the opposite sides of the duct 12 but need not extend throughout the complete width and acts to substantially equalize the velocity of air flow expelled into the passageway 18 and a corresponding equalization of the air curtain from the air slot 20 along the entire length of the hood. For example, a plate which is about a foot larger than the duct, functions to produce excellent flow equalization.

An exhaust duct unit 35 is secured to the bottom wall unit 31 at the back wall of the hood enclosure to define a dampered gas exhaust channel 36. The exhaust duct unit 35 receives the exhaust gases of the gas fired equipment 3 and directs the exhaust gases upwardly directly into the exhaust passageway 9 and the exhaust duct 11. The hood 1 is mounted adjacent the equipment 3 with the duct 35 aligned with and spaced upwardly of the flue gas exhaust flue means of equipment 3. The spacement allows introduction of secondry air into the exhausting gases as they are drawn upwardly into and through duct 35. An adjustable baffle 37 is provided in the duct 35 for adjusting the mixture and draw force created in the duct 35 to establish proper exhaust of the combination gases for different equipment without disturbing the pilot flame. A cover panel 38 is located over the gas passageway to prevent any foreign matter from dropping into the gas exhaust, during the operation of the exhaust hood.

Although particulary shown and described for gas fired equipment, the invention is equally useful for electric cooking equipment, as well as other applications requiring exhausting of an area. For electric equipment the exhaust duct is simply capped.

The inventor has discovered that the reorientation of the filter unit with the forward tilt in combination with the more horizontal and even upward direction of the induction stream as a substantially full bodied stream to engage the uppermost portion of the filter resulted in a significant improvement in the capture and containment of the vapors, smoke and grease, without excessive drawing of the environmental air from the room. The improved hood minimizes interference with the working area and surfaces while providing an attractive low-profile design. The table top shelf is of course desirable, for storing of plates, seasonings, and other items in convenient location for use. The filter units are cooled by the untempered air which improves the extraction and cleaning of the air, which results in cleaner and safer ducts and roof tops.

Various modes of carrying out the invention are contemplated as being within the scope of the following claims and particularly pointing out and distinctly claiming the subject matter which is regarded as the invention.

We claim:

1. A compensating back-shelf exhaust hood comprising a hood enclosure having a top wall means and a partially enclosing side wall means arranged to form an open-bottom exhaust chamber and having an opening in the side wall means for access into the enclosure, an air supply channel means having a first portion extending through the top wall means and receiving forced air and directing the air received to the front of said top wall means along a substantial portion of the length of said top wall means; deflector means at the forward portion of said top wall means for deflecting the air from said air supply channel at the front of said top wall means backwardly, a discharge slot means coupled to said deflector means and directing said air rearwardly and substantially horizontally toward said back wall as a stream of air across the upper end of said enclosure and the top portion of said open-bottom exhaust chamber, exhaust passageway means associated with said hood enclosure, and a filter means defining the back wall of the exhaust chamber and canted forwardly at an angle from the vertical with the upper end of the filter means located forwardly of the lower end toward said opening in the side wall means such that the air directed substantially horizontally and rearwardly from said slot means strikes the upper portion of said filter means approximately perpendicularly to the filter.

2. The compensating exhaust hood of claim 1 wherein said air supply channel means includes a diverging upper passageway connected to said deflector means.

3. The compensating exhaust hood of claim 1 wherein said deflector means comprises a curved deflector plate mounted to said top wall at the front thereof and having a front vertical substantially planar section connected by a curved portion to the upper supply passageway and by a curved portion to said discharge nozzle to smoothly turn said air backwardly toward said back wall, said slot includes a flat planar plate member extending from said deflector plate and a straight upper wall spaced from the deflector plate and substantially perpendicular to said filter means and being substantially parallel to said planar member to define said air stream which flows from the slot into engagement with the upper portion of said filter means.

4. The compensating exhaust hood of claim 3 wherein the spacing between said straight upper wall and said plate member is essentially in the range of 1 and 2 inches.

5. The compensating exhaust hood of claim 1 wherein said top wall unit includes an upper wall connected to said deflector wall, said slot including a lower partial wall extending from said deflector wall and a common wall forming the bottom of said first portion of said supply channel and overlapping said partial wall to form said slot, said lower partial wall extending inwardly and upwardly to said filter means, and said common wall being inclined to form with said upper wall a diverging passageway extending into said deflector means.

6. The compensating exhaust hood of claim 1 for gas fired equipment having an upwardly opening flue duct and including an exhaust duct mounted with the lower end of said exhaust passageway and adapted to be located in upwardly spaced alignment with a flue duct of said equipment, and an adjustable baffle located in said exhaust duct to control the mixture and draw force created in said exhaust gas duct means.

7. A compensating exhaust hood apparatus for exhausting of the environment over a horizontal work area, comprising an exhaust passageway means having means for mounting adjacent the rear portion of the work area and including a generally vertically disposed exhaust opening means, a top wall unit having means for mounting in overlying vertically spaced relation to the work area and extending forward of said exhaust passageway means to define an exhaust chamber overlying the work area, said top wall unit including a plurality of spaced walls defining an air supply channel extending from the rear portion to the front portion of the top wall unit, air supply means coupled to said supply channel and adapted to establish a high velocity air flow therethrough, a reverse deflector means connected to the forward end of the channel and including an essentially continuously smooth and curved passageway, a slot means connected to the curved deflector means and extending upwardly and rearwardly into the exhaust chamber and redirecting the air as a relatively narrow air stream extending over the work area within the upper end of the exhaust chamber and into said exhaust opening means, a filter means angularly oriented with the top portion located forwardly of the lower portion, and said slot means being angularly oriented whereby said air stream engages said filter means essentially perpendicular to the filter means.

8. A compensating exhaust hood for gas-fired equipment having a vertical exhaust flue means, comprising a hood enclosure having a top wall means and a partially enclosing side wall means arranged to form an open-bottom exhaust chamber and having an opening in the side wall means for access into the enclosure, an air supply channel means having a first portion extending through the top wall means and receiving forced air and directing the air received to the front of said top wall means along a substantial portion of the length of said top wall means; deflector means at the forward portion of said top wall means for deflecting the air from said air supply channel at the front of said top wall means backwardly, a discharge slot means coupled to said deflector means and directing said air toward said back wall as a stream of air across the upper end of said enclosure, an exhaust passageway means associated with said hood enclosure, and a filter means forming a common wall between the exhaust chamber and the exhaust passageway, and exhaust gas duct means secured within the back portion of the hood and located in upwardly spaced and aligned relation to said exhaust flue means, and an adjustable baffle means located in said exhaust gas duct means and operable to adjust the mixture and draw force created in said exhaust gas duct means.

9. the apparatus of claim 8 including an upper cover panel means secured over said exhaust gas duct means to prevent foreign matter from dropping into said exhaust gas duct means.

* * * * *

UNITED STATES PATENT AND TRADEMARK OFFICE

CERTIFICATE OF CORRECTION

PATENT NO. : 4,541,409

DATED : 9/17/85

INVENTOR(S) : Daniel Karst, et al.

It is certified that error appears in the above-identified patent and that said Letters Patent is hereby corrected as shown below:

In the abstract, line 27, after "and" delete "the". In the Specification, Column 5, Line 62, after "wall" cancel "end" and substitute therefor "and". In the Specification, Column 6, Line 59, cancel "secondry" and substitute therefor "secondary" In the Claims, Claim 9, Column 10, Line 3, cancel "the" and substitute therefor "The".

Signed and Sealed this

*Seventh* Day of *January 1986*

[SEAL]

*Attest:*

*Attesting Officer*

DONALD J. QUIGG

*Commissioner of Patents and Trademarks*